US009646793B2

(12) United States Patent
Jordan et al.

(10) Patent No.: US 9,646,793 B2
(45) Date of Patent: May 9, 2017

(54) OFFSET BUS CONNECTION WITH FIELD SHAPING AND HEAT SINK

(71) Applicant: SCHNEIDER ELECTRIC USA, INC., Palatine, IL (US)

(72) Inventors: Jeffrey T. Jordan, Franklin, TN (US); Alan K. Shepherd, McMinnville, TN (US); Edgar Avalos Ortiz, Murfreesboro, TN (US)

(73) Assignee: Schneider Electric USA, Inc., Andover, MA (US)

( * ) Notice: Subject to any disclaimer, the term of this patent is extended or adjusted under 35 U.S.C. 154(b) by 52 days.

(21) Appl. No.: 14/658,218

(22) Filed: Mar. 15, 2015

(65) Prior Publication Data

US 2016/0268086 A1 Sep. 15, 2016

(51) Int. Cl.

| | |
|---|---|
| ***H01H 71/10*** | (2006.01) |
| ***H01H 1/38*** | (2006.01) |
| ***H01H 9/52*** | (2006.01) |
| *H01R 25/16* | (2006.01) |
| *H01R 4/60* | (2006.01) |
| *H01H 1/62* | (2006.01) |
| *H01H 33/02* | (2006.01) |
| *H01H 33/24* | (2006.01) |

(52) U.S. Cl.

CPC ..... *H01H 71/10* (2013.01); *H01H 1/38* (2013.01); *H01H 9/52* (2013.01); *H01H 1/62* (2013.01); *H01H 33/025* (2013.01); *H01H 33/24* (2013.01); *H01H 2009/526* (2013.01); *H01R 4/60* (2013.01); *H01R 25/16* (2013.01)

(58) Field of Classification Search

CPC ..... H01H 11/00; H01H 33/022; H01R 25/16; H01R 25/14; H01R 4/60

USPC ..... 200/401, 400, 303; 439/212, 721, 213, 439/712

See application file for complete search history.

(56) References Cited

U.S. PATENT DOCUMENTS

| | | | | |
|---|---|---|---|---|
| 3,662,137 A | | 5/1972 | Cleaveland | |
| 5,594,224 A | * | 1/1997 | Tanimizu | H01H 33/66 218/134 |
| 6,291,783 B1 | * | 9/2001 | Nebon | H02B 11/10 200/308 |

(Continued)

FOREIGN PATENT DOCUMENTS

| | | | | |
|---|---|---|---|---|
| CN | 1826714 | | 8/2006 | |
| DE | 102008033495 | * | 1/2010 | H02B 11/10 |
| WO | 2005008854 | | 1/2005 | |

*Primary Examiner* — Renee Luebke
*Assistant Examiner* — Ahmed Saeed
(74) *Attorney, Agent, or Firm* — Locke Lord LLP

(57) ABSTRACT

Method and apparatus for reducing the minimum clearance needed between an electrical conductor and ground in switchgear and similar electrical isolation equipment provide a bus-connector having an extended toroidal shape that is designed to allow the size of the switchgear cabinet to be reduced while complying with industry-standard performance requirements. The toroidal shaped bus-connector has mostly or only smooth and rounded surfaces so there are no hard or sharp edges or corners from which electrical discharge from/to ground or other conductors may occur. The shaped bus-connector also has an elongated body that produces an offset connection resembling a "Z," which allows power buses and breaker terminals that do not vertically line up to connect.

13 Claims, 7 Drawing Sheets

(56) References Cited

U.S. PATENT DOCUMENTS

| | | | |
|---|---|---|---|
| 7,473,847 | B2 | 1/2009 | Sainz De La Maza Escobal et al. |
| 7,622,669 | B2 | 11/2009 | Donazzi et al. |
| 2013/0083485 | A1 | 4/2013 | Tong et al. |

* cited by examiner

OFFSET BUS CONNECTION WITH FIELD SHAPING AND HEAT SINK

FIELD OF THE INVENTION

The disclosed embodiments relate generally to switchgear and similar electrical isolation equipment, and particularly to methods and apparatuses for reducing the minimum clearance required between an electrical conductor and ground in such isolation equipment while also improving the heat sinking capability of such isolation equipment.

BACKGROUND OF THE INVENTION

Switchgear and similar electrical isolation equipment are highly regulated by industry standards (e.g., IEEE, ANSI, etc.). Among other things, these standards define the minimum clearance or spacing required in the absence of substantiating test documentation between exposed portions of adjacent conductors, such as adjacent electrical power buses, as well as from those conductors to ground for various voltage levels. This minimum clearance helps prevent electrical discharge between adjacent conductors and from a conductor to ground. The clearances are described in terms of direct or "strike" distances and linear surface or "tracking" distances. For example, in 15 kV switchgear, a minimum strike distance of at least 125 mm (4.9 inches) is typically required between the exposed portion of a conductor and ground.

Because of the industry-standard requirements, switchgear cabinets have heretofore needed to be a certain size or larger. Efforts to reduce switchgear cabinet sizes while satisfying the minimum clearance requirements have largely been unsuccessful. Additionally, in many switchgear applications, low-voltage current transformers ("CT") are mounted around the electrical power buses to monitor and measure current flow. But low-voltage current transformers tend to be relatively large and bulky, which requires greater separation between the buses. The greater separation can be particularly problematic when deploying smaller footprint circuit breakers, such as the Evolis™ series of medium voltage circuit breakers from Schneider Electric USA, Inc. Due to their smaller size, these medium voltage circuit breakers have breaker terminals (e.g., upper or line side and lower or load side breaker terminals) that are located closer together so the breaker terminals are vertically offset from the power buses, which have a greater inter-bus separation. Furthermore, the power bus and breaker terminal can become extremely hot due to the large amounts of current flowing through them and heat sinks are typically needed to keep their temperature at or below a target level, which can add cost and complexity to the switchgear.

Thus, a need exists for a way to reduce the clearance needed between an electrical conductor and ground in switchgear and similar electrical isolation equipment while complying with industry-standard clearance requirements and also improving the heat sinking capability of such isolation equipment.

SUMMARY OF THE DISCLOSED EMBODIMENTS

The embodiments disclosed herein are directed to a method and apparatus for reducing the minimum clearance needed between an electrical conductor and ground in switchgear and similar electrical isolation equipment. The embodiments provide a bus-connector having a shape that is designed to allow the size of the switchgear cabinet to be reduced while complying with industry-standard performance requirements. The shaped bus-connector has mostly or only smooth and rounded surfaces so there are no hard or sharp edges or corners from which electrical discharge from/to ground or other conductors may occur. This use of smooth and rounded surfaces to limit or prevent electrical discharge from/to an electrical conductor is generally known as "field shaping" and allows the conductor to be located nearer to ground or other conductors than would conventionally be the case. The shape of the bus-connector also produces an offset connection that resembles a "Z," allowing power buses and breaker terminals that do not vertically line up, such as with smaller circuit breakers like the Evolis™ series of circuit breakers, to connect. The ability to use these smaller circuit breakers together with the reduced clearance required from the shaped bus-connector to ground allows the size of the switchgear cabinet to be reduced while complying with industry-standard clearance requirements.

In some embodiments, the shaped bus-connector may be composed of a generally cylindrical head for receiving and connecting to a power bus and a generally flat, elongated body for connecting to a breaker terminal. The generally cylindrical head has a circular opening coaxially disposed at one end, for example, the bus facing end, that extends about a quarter of the way into the head, forming a hollow in the bus end of the head. The opposite or breaker facing end of the head may also have an opening disposed therein, or it may be a solid mass entirely filled in to provide the bus-connector with greater heat sinking capacity. In either case, both the bus and breaker ends of the head are rounded or curved so there are no hard corners or edges along the surfaces of the head. The radius of curvature of the corners and edges may vary from slightly rounded on some corners and edges to arcuate on other corners and edges, with a preferred radius of curvature of about half an inch on most corners and edges. The curved corners and edges give the head a toroidal shape that softens the electric field density and shapes the equipotential lines around the power-supply-bus-to-breaker-terminal connection to prevent or limit electrical discharge between the bus-connector and ground.

The elongated body protrudes perpendicularly from the generally cylindrical head near the bus end thereof. Like the generally cylindrical head, the elongated body has mostly or only smooth and rounded surfaces so there are no sharp or hard edges or corners. In some embodiments, the elongated body may have a width that is about the same as an outer diameter of the generally cylindrical head, but progressively narrows in a direction away from the head toward the end of the elongated body that connects to the breaker terminal. This narrowing produces a generally flat-sided frustoconical shape that gives the bus-connector an appearance of a conventional coin-operated parking meter when viewed from the front of the head. The thickness and height of the elongated body may be chosen based on the particular needs of the application. For example, a shorter/longer body may be required where the vertical offset between the power bus and the breaker terminal is smaller/larger. Likewise, the thickness of the elongated body may be a certain percentage or ratio of the length of the generally cylindrical head.

To make a connection, the breaker terminal is simply screwed, bolted, or otherwise attached to the elongated body through bore holes in the body, while the power bus is inserted in the bus end opening, or hollow, of the generally cylindrical head and similarly attached thereto via bore holes extending through the head. In embodiments where the breaker end of the generally cylindrical head has an opening, or hollow, formed therein, an internal partition may be provided within the head between the bus end opening and the breaker end opening and the power bus may be attached to this internal partition via bore holes in the partition.

In general, in one aspect, the disclosed embodiments relate to a shaped bus-connector comprising a generally cylindrical head having an exterior wall extending along a length of the head and an interior wall extending a distance into the head, the interior wall defining an opening in the head coaxial therewith at an end thereof. The shaped bus-connector further comprises an elongated body protruding perpendicularly from the generally cylindrical head at the end thereof having the opening therein. The generally cylindrical head has a shape resembling an extended toroid such that corners and edges on the head through which electrical discharge may occur have a radius of curvature.

In general, in another aspect, the disclosed embodiments relate to a circuit breaker module for a switchgear comprising an electrical conductor and a circuit breaker having a breaker terminal thereon to which the electrical conductor may be electrically connected. The circuit breaker module also comprises a cradle on which the circuit breaker is mounted, the cradle having a grounded isolation barrier through which the electrical conductor extends, the grounded isolation barrier disposed adjacent to the circuit breaker. The circuit breaker module further comprises a shaped bus-connector connecting the electrical conductor to the breaker terminal, the shaped bus-connector having a generally cylindrical head resembling an extended toroid such that corners and edges on the head through which electrical discharge may occur have a radius of curvature.

BRIEF DESCRIPTION OF THE DRAWINGS

The foregoing and other advantages of the disclosed embodiments will become apparent upon reading the following detailed description and upon reference to the drawings, wherein.

DETAILED DESCRIPTION OF THE DISCLOSED EMBODIMENTS

As an initial matter, it will be appreciated that the development of an actual, real commercial application incorporating aspects of the disclosed embodiments will require many implementation specific decisions to achieve the developer's ultimate goal for the commercial embodiment. Such implementation specific decisions may include, and likely are not limited to, compliance with system related, business related, government related and other constraints, which may vary by specific implementation, location and from time to time. While a developer's efforts might be complex and time consuming in an absolute sense, such efforts would nevertheless be a routine undertaking for those of skill in this art having the benefit of this disclosure.

It should also be understood that the embodiments disclosed and taught herein are susceptible to numerous and various modifications and alternative forms. Thus, the use of a singular term, such as, but not limited to, "a" and the like, is not intended as limiting of the number of items. Similarly, any relational terms, such as, but not limited to, "top," "bottom," "left," "right," "upper," "lower," "down," "up," "side," and the like, used in the written description are for clarity in specific reference to the drawings and are not intended to limit the scope of the invention.

Figure 1:
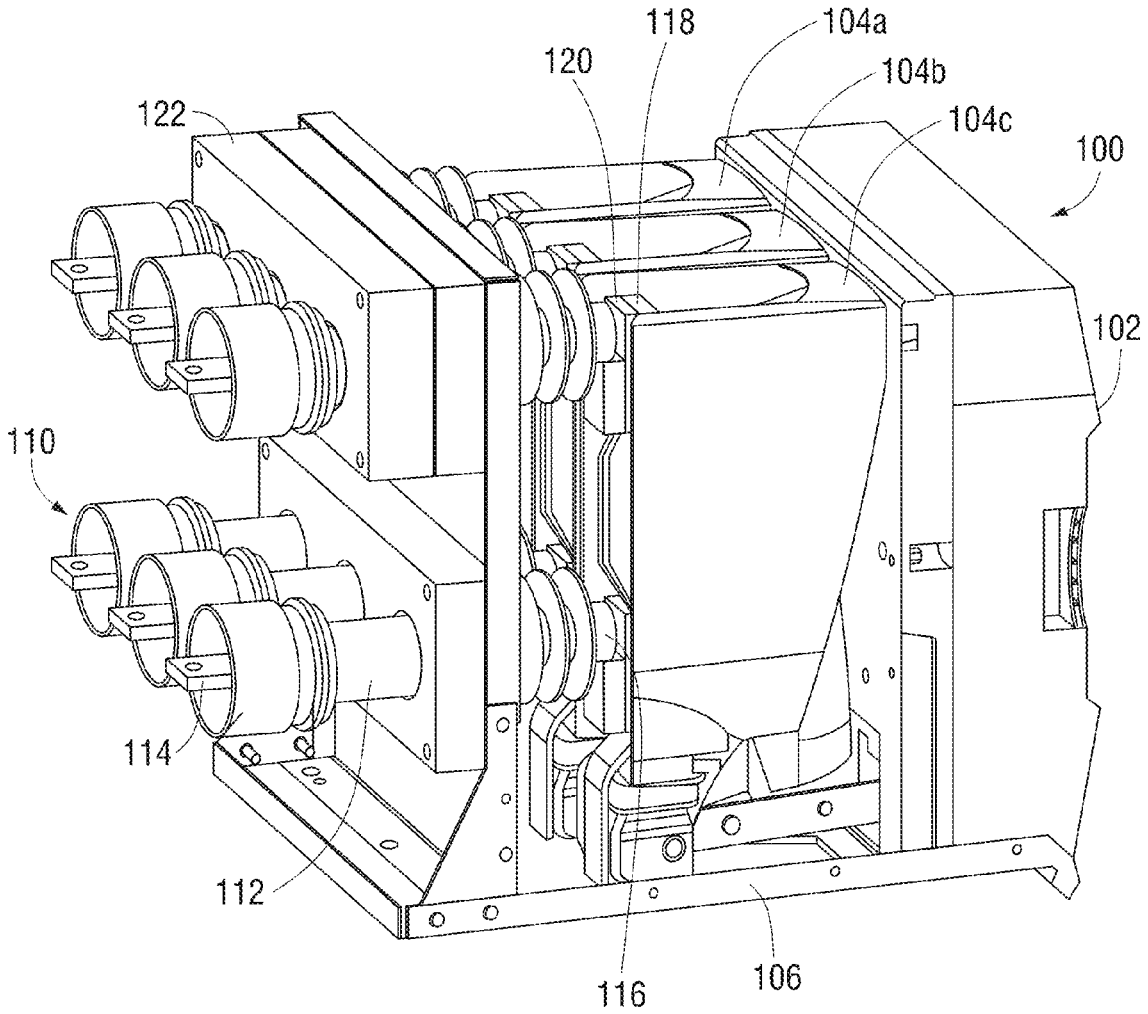
FIG. 1 (Prior Art)
FIG. 1 is a perspective view of a typical fixed-mounted or drawout circuit breaker module that may be used in switchgear.

Referring now to FIG. 1, an example of a circuit breaker module 100 for a switchgear is shown. The circuit breaker module 100 depicted here is a typical fixed-mounted or drawout circuit breaker module 100 commonly used in medium voltage switchgear. It should be understood that any reference to medium voltage switchgear, that is, switchgear with voltage ratings generally between 1 kV-35 kV, is illustrative only and that the principles and concepts discussed herein are also applicable to low and high voltage ratings. This understanding also applies equally to medium voltage circuit breakers and other electrical switching devices. As can be seen, the circuit breaker module 100 includes a 3-pole circuit breaker 102, for example, an Evolis™ medium voltage circuit breaker, with each pole being generally indicated at 104*a*, 104*b*, and 104*c*. The circuit breaker module 100 also includes a drawout breaker cradle or mounting frame (generally indicated at 106) on which the circuit breaker 102 is mounted or otherwise installed that allows the circuit breaker 102 to be racked in and out of the switchgear cabinet (not expressly shown) as needed.

The drawout breaker cradle 106 is usually grounded and comprises a wall or barrier 108 disposed adjacent to the circuit breaker 102 to isolate and separate the circuit breaker 102 from other electrical equipment. The grounded isolation barrier 108 usually has several holes therein (not visible here) through which electrical bushings, one of which is indicated at 110, may pass for connecting electrical conductors, such as power buses, to the circuit breaker 102. Each bushing 110 usually includes an insulating shaft 112 surrounding a power bus 114 that extends coaxially through the shaft 112 to a terminal end 116 where the power bus 114 may be electrically connected to a breaker terminal 118 of the circuit breaker 102 via a conductive plate connector 120 or the like. An example of a bushing 110 that is well suited for use with the circuit breaker module 100 is described in U.S. application Ser. No. 14/312,671, entitled "Compact Transformer Bushing 110," filed Jun. 23, 2014, and incorporated herein by reference. Current transformers ("CT"), one of which is indicated at 122, may be mounted on one or more of the bushings 110 to help monitor and measure the current flowing through the line and load power buses 114.

In addition, to satisfy industry-standard clearance requirements, a minimum strike distance is typically required from the point where the power buses 114 connect electrically to the breaker terminals 118 and the grounded isolation barrier 108. In 15 KV switchgear, for example, a minimum strike distance of at least 125 mm (4.9 inches) is required. As discussed earlier, efforts to reduce this minimum strike distance have largely been unsuccessful, necessitating that switchgear cabinets be at least a certain size or larger to accommodate the required clearance.

Figure 2:
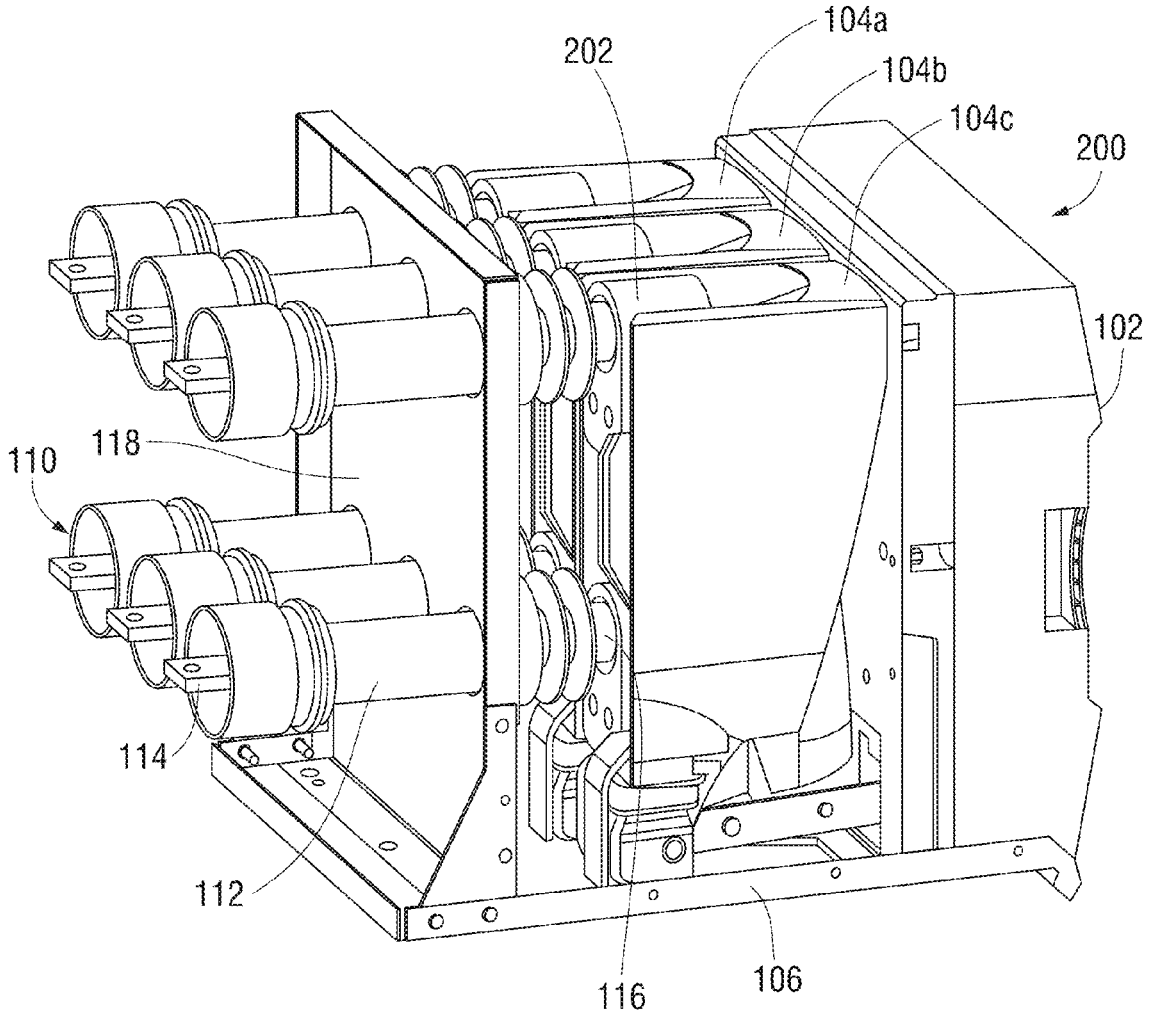
FIG. 2 is a perspective view of a drawout circuit breaker module having a shaped bus-connector therein according to some implementations of the disclosed embodiments.

FIG. 2 illustrates a switchgear circuit breaker module 200 that is virtually identical to the circuit breaker module 100 of FIG. 1 except that a shaped bus-connector 202 has replaced the conventional conductive plate connector 120. This shaped bus-connector 202, which may be made of any suitable conductive material (e.g., copper, aluminum, gold, steel, etc.), benefits from the field shaping mentioned earlier to allow the size of the switchgear cabinet to be reduced while complying with industry-standard clearance requirements. Specifically, the shaped bus-connector 202 is shaped to have mostly or only smooth and rounded surfaces so there are no hard or sharp edges or corners through which electrical discharge may occur. The lack of hard edges or corners allows the bus-connector 200 to be located nearer to the grounded isolation barrier 108 or other conductors relative to conventional conductive plate connectors. For example, a roughly 30% to 35% reduction in clearance to the grounded isolation barrier 108 has been observed in some industry-standard testing when using the shaped bus-connector 200 disclosed herein. In addition, the shape of the bus-connector 200 produces an offset connection that resembles a "Z" to allow power buses 114 and breaker terminals 118 that are vertically misaligned to be connected.

Figure 3C:
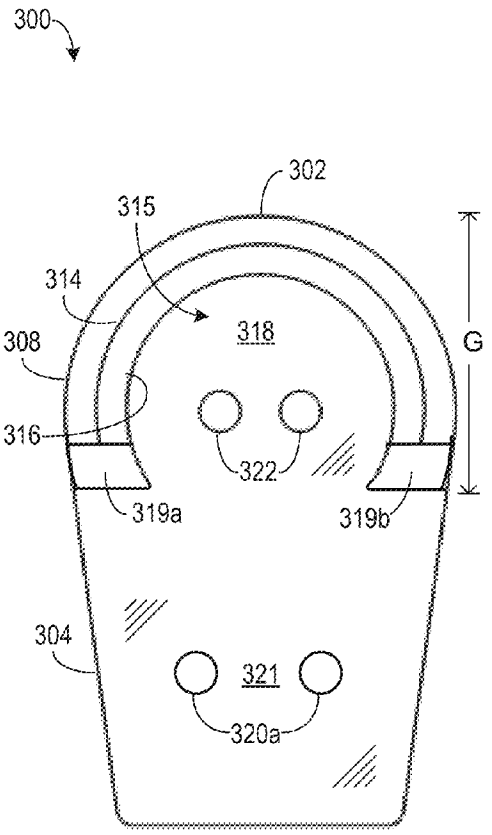
FIGS. 3A, 3B, and 3C are front, side, and rear views, respectively, of a shaped bus-connector according to some implementations of the disclosed embodiments.
Figure 3B:
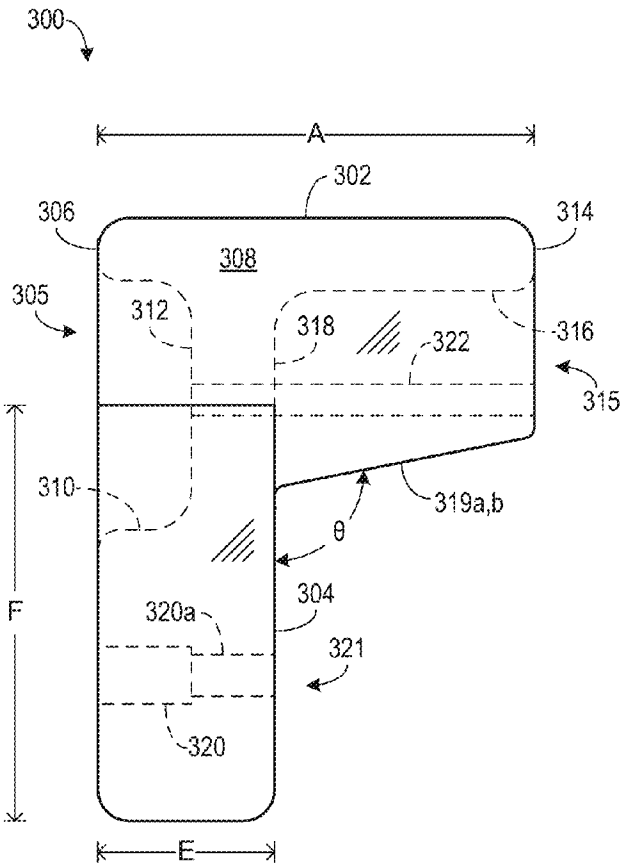
Figure 3A:
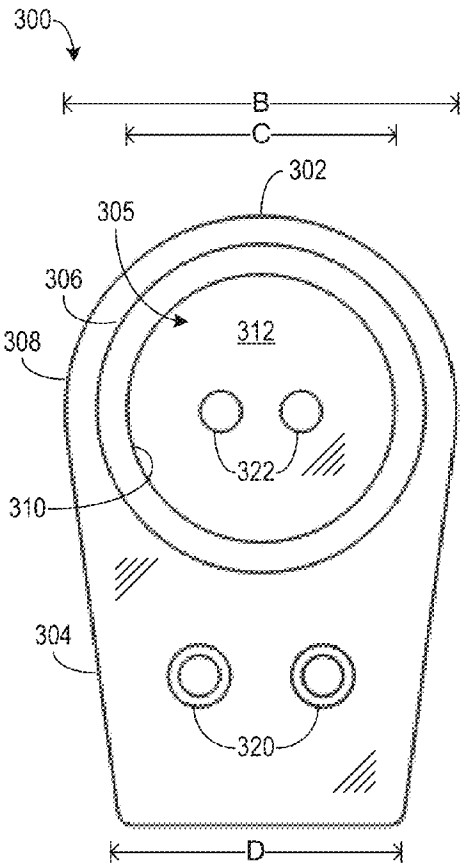

Details of the disclosed shaped bus-connector may be discerned from FIGS. 3A, 3B, and 3C showing front, side, and rear views, respectively, of a shaped bus-connector 300, respectively. As can be seen, in some embodiments, the shaped bus-connector 300 has a generally cylindrical head 302 and a generally flat, elongated body 304. The generally cylindrical head 302 has a circular opening or hollow 305 coaxially disposed at one end, for example, the front or bus facing end 306, for receiving and connecting a power bus 114 to the bus-connector 300. This bus end opening or hollow 305 is generally surrounded by an exterior wall 308 that extends a length "A" of about 3.24 inches along the generally cylindrical head 302 and an interior wall 310 that extends about 0.88 inches into the head 302, terminating at a back wall 312. The exterior wall 308 may have a diameter "B" of about 3.70 inches and the interior wall 310 may have a diameter "C" of about 2.28 inches in some embodiments, depending on the specific application.

The rear or breaker facing end 314 of the generally cylindrical head 302 may also have an opening 315 disposed therein in some embodiments that is defined by a second interior wall 316 and a second back wall 318, as best seen in FIG. 3C. As can be seen in FIG. 3C, the breaker end 314 does not form a closed circle like the bus end 306, but is instead a partially open circle of about 190 degrees or a little past horizontal, for example, that somewhat resembles a horseshoe having a height "G" of about 2.17 inches, for example, when viewed from the rear of the head 302. Such a horseshoe shaped breaker end 314 may have a height "G" of about 2.17 inches in some embodiments. Also as best seen in FIG. 3B, in some embodiments, angled slopes 319*a* and 319*b* may extend from the breaker end 314, one slope on either side of the breaker 314, down toward the elongated body 304 at an angle "θ" of about 103 degrees, for example, relative to the elongated body 304. In alternative embodiments, the breaker end 314 of the generally cylindrical head 302 may be a solid mass that has no opening, but is instead entirely filled in to provide the bus-connector 300 with improved heat sinking capacity. For example, a shaped bus-connector 300 having a filled in generally cylindrical head 302 with the dimensions above has been observed in some industry-standard testing to reduce the temperature near the power-supply-bus-to-breaker-terminal connection by about 3 to 6 degrees Celsius.

In accordance with the disclosed embodiments, both the bus end 306 and breaker end 314 of the generally cylindrical head 302 have rounded or curved surfaces so there are no hard corners or edges along any of the surfaces of the head 302. The radius of curvature of the corners and edges may vary from only slightly rounded on some corners and edges to arcuate on other corners and edges, and is preferably about half an inch on most corners and edges. This gives the generally cylindrical head 302 an elongated toroidal shape that helps hold down the electrical fields surrounding the power-supply-bus-to-breaker-terminal connection to prevent or limit electrical discharge between the head 302 and the grounded isolation barrier 108. Consequently, the generally cylindrical head 302 allows the use of a smaller clearance to the grounded isolation barrier 108 than would otherwise be permitted with conventional conductive plate connectors.

The elongated body 304 of the bus-connector 300 extends perpendicularly from the generally cylindrical head 302 near the bus end 306 thereof and is configured to be connected to the breaker terminal Like the generally cylindrical head 302, the elongated body 304 has mostly or only smooth and rounded surfaces so there are no hard or sharp edges or corners. In some embodiments, the width of the elongated body 304 where it meets the generally cylindrical head 302 is about the same as the outer diameter "B" of the generally cylindrical head 302. This width "B" progressively narrows to a smaller width "D" of about 2.6 inches in a direction away from the head 302 toward the breaker terminal end of the elongated body 304. The narrowing produces a generally flat-sided frustoconical shape that gives the bus-connector 300 an appearance of a conventional coin-operated parking meter when viewed from the front of the head 302. As for the thickness "E" and the height "F" of the elongated body 304, these dimensions may be chosen based on the particular needs of the application and may be about 1.38 inches and 3.43 inches, respectively, in some embodiments. Of course, a shorter/longer body 304 may be required where the vertical misalignment between the power bus 114 and the breaker terminal 118 (see FIG. 2) is smaller/larger. In a similar manner, the thickness of the elongated body may be a particular percentage (e.g., 25 percent, etc.) or ratio of the length "A" of the generally cylindrical head 302.

In general operation, the breaker terminal 118 is simply screwed, bolted, or otherwise attached to the elongated body 304 of the bus-connector 300 through bore holes 320 formed in the body 304 near a breaker terminal connection site 321, while the power bus 114 is inserted in the opening 305 at the bus end 306 of the head 302 and likewise attached via bore holes 322 extending through the head 302. In embodiments where the breaker end 314 of the generally cylindrical head 302 also has an opening 315 formed therein, the back walls 312 and 318 serve as an internal partition to which the power bus 114 may be attached via the bore holes 322. For either arrangement, the end result is that the connection between the power bus 114 and the breaker terminal 118 may be located closer to the grounded isolation barrier 108 due to the softening of the electrical field by the toroidal shape of the head 302. As well, because the bus-connector 300 provides an offset connection, smaller circuit breakers 102 that do not vertically line up with the power buses 114 may still be used in the switchgear cabinet.

Figure 4C:
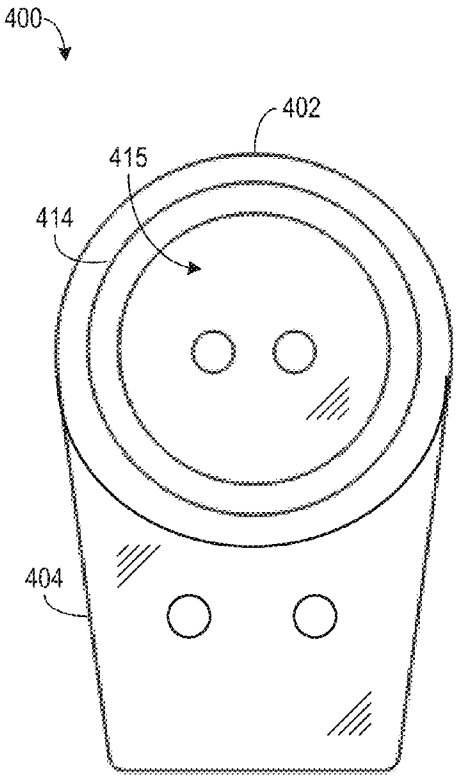
FIGS. 4A, 4B, and 4C are front, side, and rear views, respectively, of an alternative shaped bus-connector according to some implementations of the disclosed embodiments.
Figure 4B:
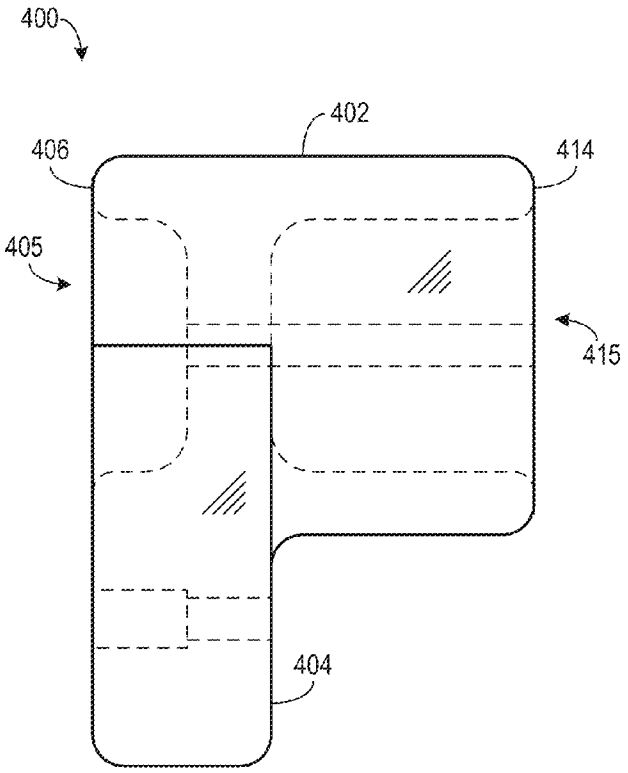
Figure 4A:
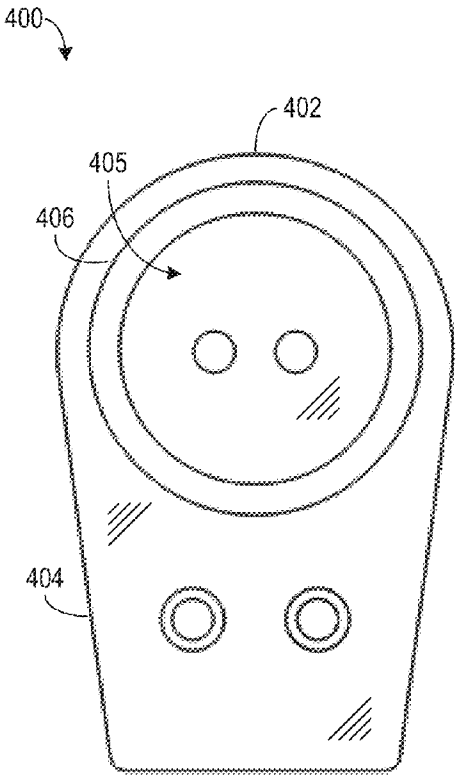

FIGS. 4A, 4B, and 4C show front, side, and rear views, respectively, of an alternative embodiment of a shaped bus-connector 400 according to the disclosed embodiments. The shaped bus-connector 400 in FIGS. 4A-4C is virtually identical to the shaped bus-connector 300 in FIGS. 3A-3C insofar as there is a generally cylindrical head 402 and a generally flat, elongated body 404, and the head 402 has a circular opening or hollow 405 coaxially disposed therein at the front or bus facing end 406 thereof. As well, the head 402 has a rear or breaker facing end 414 in which an opening 415 may be disclose disposed. Moreover, both the bus end 406 and breaker end 414 of the generally cylindrical head 402 have rounded or curved surfaces so there are no hard corners or edges along any of the surfaces of the head 402. However, in the embodiments of FIGS. 4A-4C, the breaker end 414 forms a complete circle similar to the circle formed by the bus end 406 when viewed from the rear of the head 402, as best seen in FIG. 4C.

Figure 5:
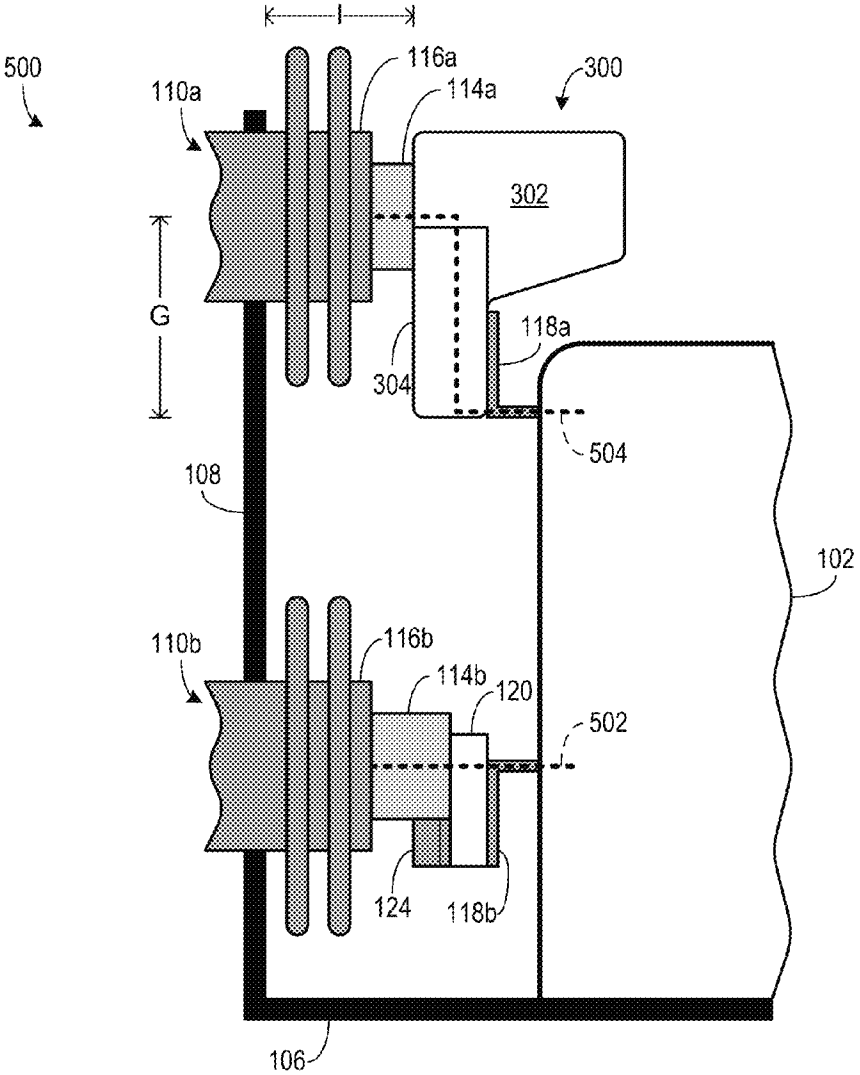
FIG. 5 is partial side view of a drawout circuit breaker module having a shaped bus-connector therein according to some implementations of the disclosed embodiments.

Turning now to FIG. 5, a partial side view of a circuit breaker module 500 is shown that uses the shaped bus-connector 300 disclosed herein. The circuit breaker module 500 resembles circuit breaker modules discussed earlier insofar as there is a circuit breaker 102 installed in a drawout breaker cradle 106 having a grounded isolation barrier 108 disposed adjacent to the circuit breaker 102. Electrical bushings 110 are also present, including an upper or line bushing 110*a* and a lower or load bushing 110*b*, with the terminal ends 116*a* and 116*b* of each bushing extending through the isolation barrier 108 and the power buses 114*a* and 114*b* in each bushing connecting to the upper and lower breaker terminals 118*a* and 118*b* of the circuit breaker 102, respectively.

In the example of FIG. 5, the lower or load side breaker terminal 118*b* is essentially aligned with the lower power bus 114*b*, as indicated by the straight dashed line 502, and thus may be connected via the conventional conductive plate connector 120. The upper or line side breaker terminal 118*a*, on the other hand, is vertically offset by a distance "H" of about 3.43 inches, for example, from the upper power bus 114*a* and therefore cannot be easily connected using a conventional conductive plate connector. However, by virtue of its elongated body 304, the bus-connector 300 disclosed herein provides an offset connection, as indicated by the "Z" shaped dashed line 504, that spans the vertical offset to allow the upper breaker terminal 118*a* to be connected to the upper power bus 114*a*.

In addition, by virtue of the extended toroidal shape its generally cylindrical head 302, the shaped bus-connector 300 has an improved ability to hold down the electrical fields surrounding the power-supply-bus-to-breaker-terminal connection. Consequently, a reduced clearance may be used between the bus-connector 300 and the grounded isolation barrier 108 compared to conventional conductive plate connectors. For example, a clearance "I" of about 90 mm (3.5 inch) from the grounded isolation barrier 108 has been observed to satisfy industry-standard testing at 95 kV when using the shaped bus-connector 300. This reduced clearance allows the overall size of the switchgear cabinet to be reduced while complying with industry-standard clearance requirements.

Moreover, in some embodiments, due to its greater mass, the shaped bus-connector 300 is capable of absorbing significantly more heat compared to conventional conductive plate connectors. For example, as mentioned above, the disclosed shaped bus-connector 300 has been observed to reduce the temperature near the power-supply-bus-to-breaker-terminal connection from approximately 3 to 6 degrees Celsius. Thus, no external heat sink needs to be attached to the shaped bus-connector 300 in order to maintain the temperature near the electrical connection point at or below a target level.

Figure 6:
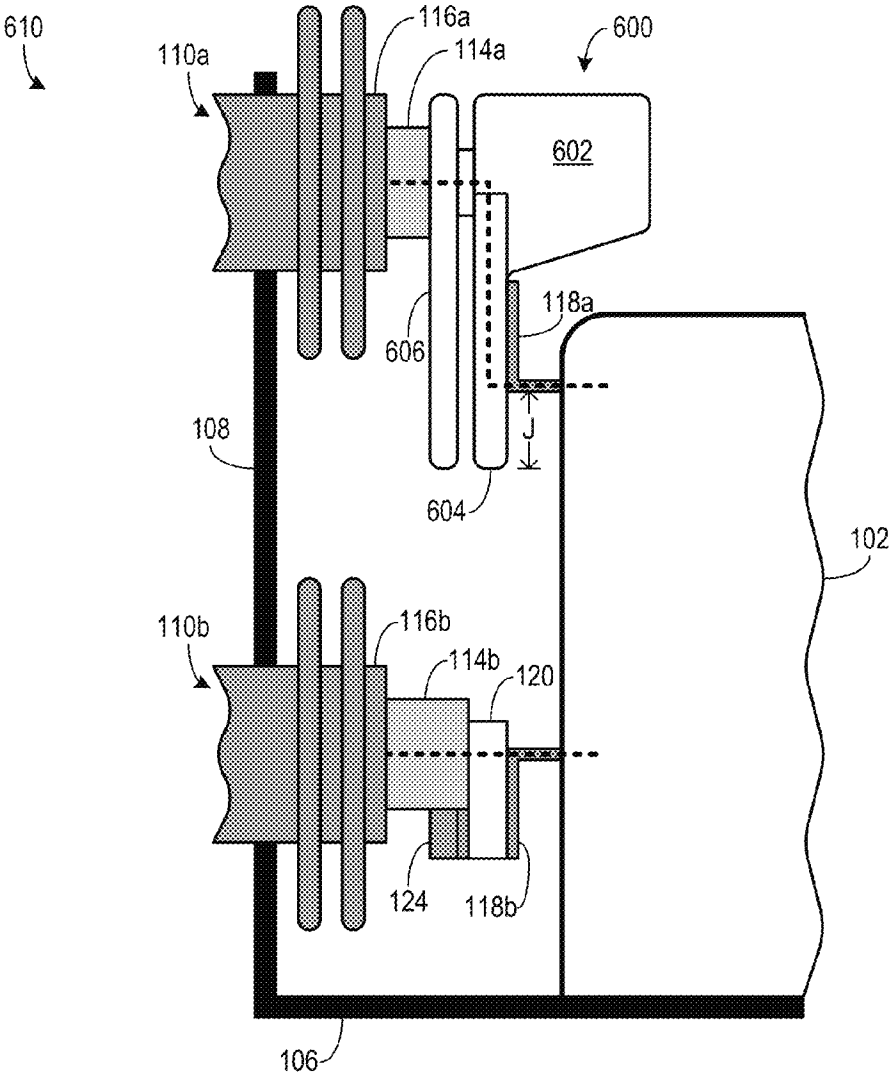
FIG. 6 is partial side view of a drawout circuit breaker module having another shaped bus-connector therein according to some implementations of the disclosed embodiments.

FIG. 6 illustrates an alternative shaped bus-connector 600 according to some embodiments. As before, a circuit breaker module 610 is shown including a circuit breaker 102 installed in a drawout breaker cradle 106 having a grounded isolation barrier 108 disposed adjacent to the circuit breaker 102. Electrical bushings 110 are once more present, including an upper or line bushing 110*a* and a lower or load bushing 110*b*, with the terminal ends 116*a* and 116*b* of each bushing extending through the isolation barrier 108 and the power buses 114*a* and 114*b* in each bushing connecting to the upper (line side) and lower (load side) breaker terminals 118*a* and 118*b* of the circuit breaker 102, respectively.

Like previous embodiments, the shaped bus-connector 600 is used to connect the vertically offset upper breaker terminal 118*a* to the upper power bus 114*a*. However, in this embodiment, the elongated body 604 of the shaped bus-connector 600 is thinner and longer than previous embodiments by an extension "J" such that the overall height of the bus-connector 600 may be about 7.0 inches. The additional length helps make up for any heat sink reduction in the mass of the bus-connector 600 resulting from having a thinner elongated body 604. To this end, in some embodiments, an optional conductive plate 606 having roughly the same thickness and length as the elongated body 604 may be attached to the bus-connector 600. The extra conductive plate 606 should of course be subjected to the field shaping process mentioned above to remove any hard or sharp edges or corners thereon through which electrical discharge may occur.

Figure 7:
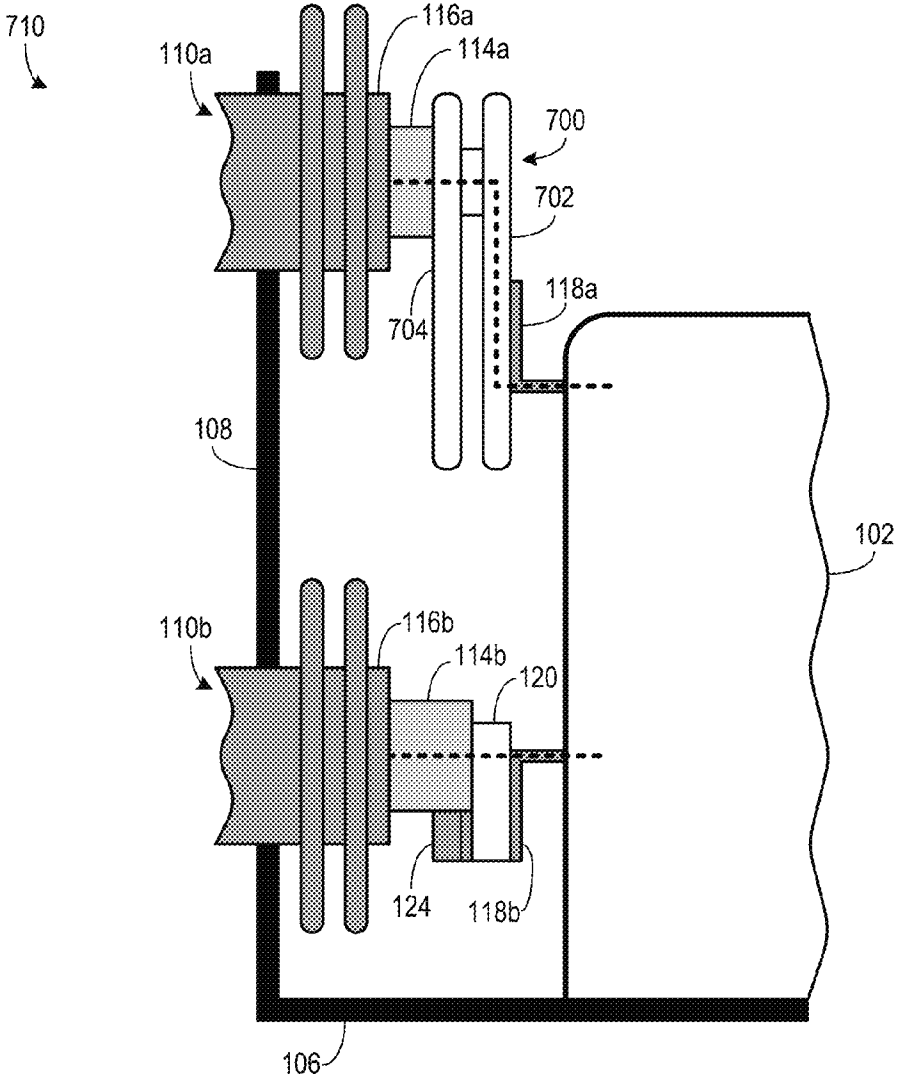
FIG. 7 is partial side view of a drawout circuit breaker module having yet another shaped bus-connector therein according to some implementations of the disclosed embodiments.

FIG. 7 illustrates an alternative way to provide the offset "Z" shaped connection according to some embodiments. In this embodiment, the shaped bus-connector 700 may be composed of two conductive plates 702 and 704 having roughly the same thickness and length as the conductive plate 606 of FIG. 6 and electrically and mechanically connected to one another. These conductive plates 702 and 704 may also be subjected to field shaping so there are no hard or sharp edges or corners thereon for the reasons mentioned above. As can be seen, the conductive plates 702 and 704 provide substantially the same offset "Z" shaped connection as the shaped bus-connectors discussed previously, but may use less conductive material owing to the lack of a generally cylindrical head and may provide less heat sinking, which may be desirable in certain applications.

While particular aspects, implementations, and applications of the present disclosure have been illustrated and described, it is to be understood that the present disclosure is not limited to the precise construction and compositions disclosed herein and that various modifications, changes, and variations may be apparent from the foregoing descriptions without departing from the spirit and scope of the disclosed embodiments as defined in the appended claims.

What is claimed is:

1. A shaped bus-connector, comprising:

a generally cylindrical head having an exterior wall extending along a length of the head and an interior wall extending a distance into the head, the interior wall defining an opening in the head coaxial therewith at an end thereof for receiving a bus connection terminal; and an elongated body protruding perpendicularly from the generally cylindrical head at the end thereof having the opening therein and the elongated body configured to be connected to a circuit breaker terminal;

wherein the generally cylindrical head has a shape resembling an extended toroid such that corners and edges on the head through which electrical discharge may occur have a radius of curvature, and whereby the shaped bus-connector provides a vertical offset between the bus connection terminal at its generally cylindrical head and the circuit breaker connection terminal at its elongated body.

2. The shaped bus-connector of claim 1, wherein the radius of curvature is about half an inch.

3. The shaped bus-connector of claim 1, wherein the generally cylindrical head is effective as a heat sink.

4. The shaped bus-connector of claim 1, wherein the opening stops at a back wall in the generally cylindrical head, the back wall having one or more bore holes therein to which a power bus may be connected.

5. The shaped bus-connector of claim 1, wherein the elongated body is shaped such that corners and edges through which electrical discharge may occur have a radius of curvature.

6. The shaped bus-connector of claim 1, wherein the elongated body has a generally flat-sided frustoconical shape with a width that progressively narrows in a direction away from the generally cylindrical head.

7. The shaped bus-connector of claim 1, wherein the elongated body has one or more breaker terminal connection sites to which a breaker terminal may be connected.

8. The shaped bus-connector of claim 7, wherein the one or more terminal connection sites include bore holes.

9. A circuit breaker module for a switchgear, comprising:

an electrical conductor with a terminal;

a circuit breaker having a breaker terminal thereon to which the electrical conductor may be electrically connected;

a cradle on which the circuit breaker is mounted, the cradle having a grounded isolation barrier through which the electrical conductor extends, the grounded isolation barrier disposed adjacent to the circuit breaker; and a shaped bus-connector connecting the electrical conductor terminal to the breaker terminal, the shaped bus-connector having a generally cylindrical head resembling an extended toroid such that corners and edges on the head through which electrical discharge may occur have a radius of curvature, the shaped bus-connector further having an elongated body protruding generally perpendicularly from the generally cylindrical head and the elongated body configured to be connected to the breaker terminal; and wherein the breaker terminal is vertically offset from the electrical conductor terminal by a distance and the shaped bus-connector provides an offset connection that bridges the distance.

10. The circuit breaker module of claim 9, wherein the generally cylindrical head allows the shaped bus-connector to have a strike distance to a grounded isolation barrier that is compliant with an industry-standard strike distance.

11. The circuit breaker module of claim 9, wherein the shaped bus-connector is a substantially solid mass that absorbs a sufficient amount of heat from the electrical conductor and the breaker terminal to maintain the electrical conductor and the breaker terminal below a target temperature.

12. The circuit breaker module of claim 9, wherein the circuit breaker is a medium voltage circuit breaker.

13. The circuit breaker module of claim 9, wherein the electrical conductor is a power bus.

* * * * *